US008491974B2

(12) United States Patent
De Vries

(10) Patent No.: US 8,491,974 B2
(45) Date of Patent: Jul. 23, 2013

(54) ARTIFICIAL TURF AND METHOD AND DEVICE FOR FORMING THEREOF

(75) Inventor: Hugo De Vries, Ridderkerk (NL)

(73) Assignee: Greenfields B.V., Jx Genemuiden (NL)

( * ) Notice: Subject to any disclaimer, the term of this patent is extended or adjusted under 35 U.S.C. 154(b) by 567 days.

(21) Appl. No.: 12/675,735

(22) PCT Filed: Aug. 21, 2008

(86) PCT No.: PCT/NL2008/000194

§ 371 (c)(1),
(2), (4) Date: Apr. 23, 2010

(87) PCT Pub. No.: WO2009/028931

PCT Pub. Date: Mar. 5, 2009

(65) Prior Publication Data

US 2010/0255223 A1 Oct. 7, 2010

(30) Foreign Application Priority Data

Aug. 27, 2007 (NL) ..... 1034291

(51) Int. Cl.

| | |
|---|---|
| ***E01C 13/08*** | (2006.01) |
| ***D03D 27/10*** | (2006.01) |
| ***D03D 39/24*** | (2006.01) |
| ***D06C 13/10*** | (2006.01) |

(52) U.S. Cl.

USPC ..... 428/17; 428/92; 428/399; 139/397; 26/13

(58) Field of Classification Search

USPC ..... 428/17, 92, 399, 397; 139/397, 291 C, 139/391; 264/103; 425/317; 26/13, 14

See application file for complete search history.

(56) References Cited

U.S. PATENT DOCUMENTS

| | | | | | |
|---|---|---|---|---|---|
| 2,476,780 | A | * | 7/1949 | Sullivan | 26/13 |
| 3,138,841 | A | * | 6/1964 | Naimer | 24/450 |
| 3,320,649 | A | * | 5/1967 | Naimer | 28/161 |
| 3,390,403 | A | * | 6/1968 | Van Tilburg | 428/92 |
| 3,837,980 | A | * | 9/1974 | Nishimura et al. | 428/17 |
| 3,957,568 | A | * | 5/1976 | Abel | 156/510 |
| 4,024,003 | A | | 5/1977 | Buhler | |
| 4,044,179 | A | * | 8/1977 | Haas, Jr. | 428/17 |
| 4,332,585 | A | * | 6/1982 | Minemura et al. | 8/114.6 |
| 4,546,020 | A | * | 10/1985 | Sakai et al. | 428/16 |

(Continued)

FOREIGN PATENT DOCUMENTS

| | | | |
|---|---|---|---|
| BE | 1000706 | A * | 3/1989 |
| JP | 62223337 | A * | 10/1987 |

(Continued)

*Primary Examiner* — Cheryl Juska

(74) *Attorney, Agent, or Firm* — Morgan Lewis & Bockius LLP; Richard F. Trecartin

(57) ABSTRACT

The invention relates to an artificial turf, comprising a backing and a number of artificial grass blades connected to the backing and extending transversely of the surface thereof, which artificial grass blades have an irregular, in particular a locally narrowed, cross-section. Owing to this locally narrowed cross-section in the vicinity of the free end thereof, these artificial grass blades greatly resemble natural blades of grass and also display similar behavior. The invention also relates to a method for forming such an artificial turf and to a device with which this method can be performed. The narrowed cross-section can herein be formed by stretching the artificial grass blades, wherein the artificial grass blades can be plasticized before, during and/or after the stretching, for instance by local heating thereof.

16 Claims, 3 Drawing Sheets

U.S. PATENT DOCUMENTS

Figure 1:
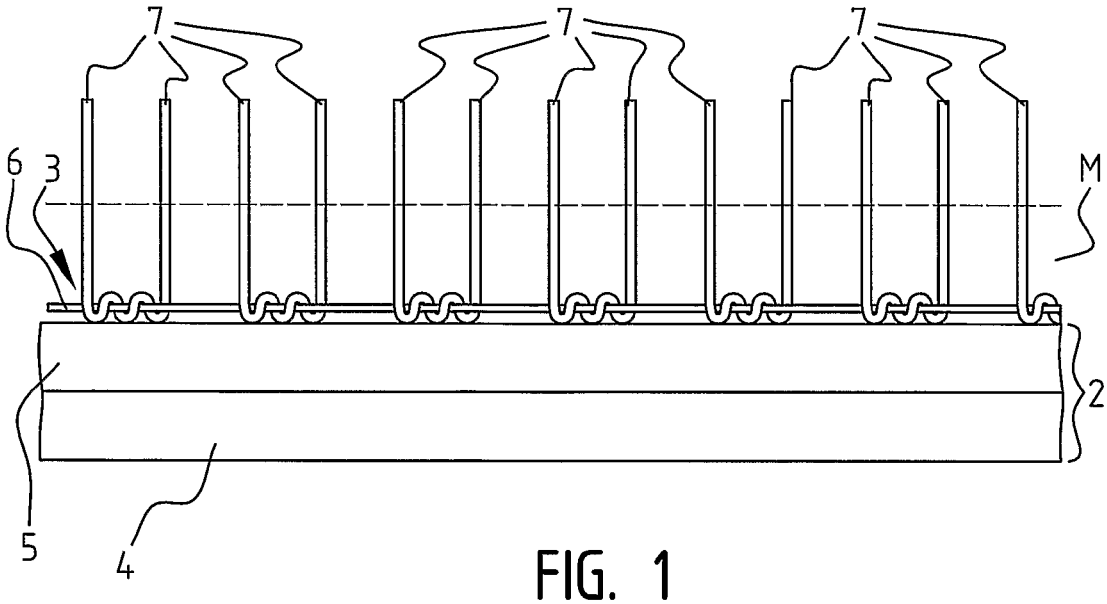

| | | | | |
|---|---|---|---|---|
| 4,613,529 | A * | 9/1986 | Yamashita et al. | 428/15 |
| 4,667,703 | A * | 5/1987 | Sakai et al. | 139/20 |
| 4,729,215 | A * | 3/1988 | Sato et al. | 57/210 |
| 4,773,135 | A * | 9/1988 | Sato et al. | 28/160 |
| 5,609,935 | A * | 3/1997 | Yamagata et al. | 428/89 |
| 6,242,062 | B1 * | 6/2001 | de Vries | 428/17 |
| 6,372,310 | B2 * | 4/2002 | de Vries | 428/17 |
| 6,432,505 | B1 * | 8/2002 | Sweenie et al. | 428/92 |
| 6,753,049 | B2 * | 6/2004 | De Vries | 428/17 |
| 7,939,144 | B2 * | 5/2011 | Verleyen | 428/17 |
| 2005/0056336 | A1 * | 3/2005 | Kim et al. | 139/397 |
| 2006/0040073 | A1 | 2/2006 | Straughn | |
| 2006/0057328 | A1 * | 3/2006 | Pacione et al. | 428/95 |
| 2006/0159917 | A1 * | 7/2006 | Verleyen | 428/364 |
| 2006/0204710 | A1 * | 9/2006 | De Vries | 428/89 |
| 2007/0269631 | A9 * | 11/2007 | Pacione et al. | 428/95 |
| 2010/0255223 | A1 * | 10/2010 | De Vries | 428/17 |

FOREIGN PATENT DOCUMENTS

| | | | |
|---|---|---|---|
| JP | 6184811 | A | 7/1994 |
| JP | 07045548 | A | 6/1995 |
| KR | 676907 | B1 * | 2/2007 |
| WO | WO 2006/091067 | A1 | 8/2006 |
| WO | WO 2010128196 | A1 * | 11/2010 |

* cited by examiner

ARTIFICIAL TURF AND METHOD AND DEVICE FOR FORMING THEREOF

This application is a National Stage application of International Patent Application No. PCT/NL2008/000194 filed Aug. 21, 2008 and published as International Publication No. WO 2009/028931 A1 on Mar. 5, 2009, which claims priority to Netherlands Patent Application No. NL1034291 filed Aug. 27, 2007, the entire contents of applications is incorporated herein by this reference.

The invention relates to an artificial turf as described in the preamble to claim 1, a method for forming such an artificial turf as described in the preamble to claim 5 and a device for forming such an artificial turf as described in the preamble to claim 14.

Artificial grass is increasingly being used to replace natural grass. Artificial grass has the advantage that it can be played on in almost all weather conditions, whereby for instance sports fields can be better utilized. Nor of course does artificial grass need any nutrients, so it can also be used in for instance very dry and warm regions. In addition, artificial grass requires considerably less maintenance than natural grass and has a longer lifespan, so that the costs are relatively low.

Artificial grass fields consist generally of a ground of for instance sand or rubble, on which is arranged a resilient damping layer with the actual artificial turf thereon. Sand, optionally mixed with rubber granules, can further be scattered in this artificial turf. The artificial turf itself consists of a backing to which a large number of artificial grass blades are attached. These artificial grass blades are usually connected to the backing by tufting or weaving. In practice large numbers of synthetic fibres are woven or tufted into the backing, after which the thus formed loops or piles are cut open.

The relatively complicated structure of an artificial grass field, with a plurality of layers of different materials, is necessary in order to emulate as closely as possible the properties of a natural grass field. This is an important requirement for allowing artificial grass to be used in sport at competitive level.

A problem with artificial grass is that the artificial grass blades, which are after all formed by industrially manufactured—in particular extruded—synthetic fibres, do not yet sufficiently emulate the properties of natural grass blades. Particularly the variation in form and dimensions of the blades occurring in a natural grass field have heretofore been almost impossible to replicate in artificial grass. Although proposals have been made for combining artificial grass blades of different materials or of different thicknesses into a single artificial turf, this results in complicated constructions which cannot be produced at acceptable cost, or hardly so, with the usual manufacturing techniques.

The invention now has for its object to provide an artificial turf, the artificial grass blades of which are a more faithful likeness of natural grass blades than is the case in conventional artificial turfs, and the performance characteristics of which therefore more closely approximate those of a natural grass field. According to the invention this is achieved, in an artificial turf comprising a backing and a number of artificial grass blades connected to the backing and extending substantially transversely of the surface thereof, in that at least some of the artificial grass blades have an irregular cross-section. By giving the artificial grass blades, or at least some of them, an irregular cross-section they more closely resemble natural grass blades.

The sought after irregularity can be achieved when at least some of the artificial grass blades have a cross-section which is narrowed at least locally.

In a preferred embodiment of the artificial turf according to the invention the artificial grass blades comprise a base part connected to the backing and a free end part, and the narrowed cross-section is located at the position of or in the vicinity of the free end part. In this manner natural blades of grass, which after all also have a relatively wide, strong and stiff base and taper to a point therefrom, are faithfully imitated.

This effect can be achieved in relatively simple manner when the artificial grass blades with locally narrowed cross-sections are stretched.

The invention further relates to a method for forming an artificial turf, which method comprises the steps of providing a backing and connecting to the backing a number of artificial grass blades extending substantially transversely of the surface thereof, wherein the artificial grass blades are formed by providing a number of synthetic fibres, connecting the synthetic fibres to the backing, and cutting to a desired length the artificial fibres connected to the backing. According to the invention at least some of the artificial grass blades are herein formed with an irregular cross-section.

As indicated above, at least some of the artificial grass blades are preferably formed with an at least locally narrowed cross-section, which is advantageously formed at the position of or in the vicinity of a free end part of each artificial grass blade.

The narrowed cross-section is preferably further formed by stretching the artificial grass blades. In order to simplify this stretching and to prevent the artificial grass blades becoming stronger and harder because of this deformation, the artificial grass blades can be plasticized before, during and/or after the stretching. This plasticizing of the artificial grass blades can for instance be achieved by at least local heating thereof. It is otherwise also possible to envisage other methods of supplying energy for the purpose of plasticizing the blades.

The irregular cross-section is preferably formed prior to cutting the synthetic fibres to the desired length. This is because the synthetic fibres can still be handled and processed relatively well.

In a variant of the method which is recommended at this moment the synthetic fibres are connected to the backing by means of double-weaving, wherein two mutually parallel, spaced-apart backings are provided in each case and the synthetic fibres are woven through both backings and then severed between the backings, and the irregular cross-section is formed before severing of the synthetic fibres. Two artificial turfs are thus manufactured in a single operation, both being provided with artificial grass blades with the desired irregular, locally narrowed cross-section.

The artificial grass blades can here be stretched in simple manner when the interspacing between the backings is increased prior to severing of the synthetic fibres.

Finally, the invention also relates to a device with which the above described method can be applied for the purpose of producing an artificial turf having artificial grass blades with irregular cross-section. For this purpose the invention provides a device for forming an artificial turf, comprising first supply means for supplying a backing, second supply means for supplying a number of synthetic fibres, connecting means for connecting the synthetic fibres to the backing, and cutting means for cutting to a desired length the synthetic fibres connected to the backing. According to the invention this device is adapted to form at least some of the artificial grass blades with an irregular cross-section.

The device is particularly adapted to form artificial grass blades with a locally narrowed cross-section, in particular at the position of or in the vicinity of the free end part.

A preferred embodiment of the device according to the invention is provided with means for stretching the artificial grass blades. In addition, the device can be provided with means co-acting with the stretching means for plasticizing the artificial grass blades.

As indicated above, these plasticizing means can be adapted to heat the artificial grass blades at least locally. When the connecting means are adapted to connect the synthetic fibres to the backing in mutually parallel rows, the plasticizing means preferably comprise a number of heating members placed between the rows. All the synthetic grass blades are thus heated to more or less the same extent.

In a preferred embodiment of the device according to the invention, with which a large quantity of artificial turf with irregular artificial grass blades can be manufactured in simple manner, the connecting means comprise a double loom which is provided with two weaving frames disposed spaced-apart and parallel to each other, and discharge conveyors connecting thereto, the cutting means are placed between the discharge conveyors and the device is adapted to give the synthetic fibres an irregular cross-section upstream of the cutting means.

A structurally simple embodiment of the device is obtained here when the stretching means are adapted to move the discharge conveyors apart upstream of the cutting means.

Figure 2:
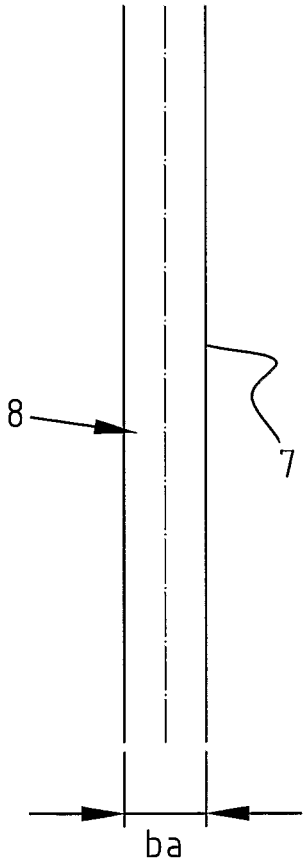
Figure 3:
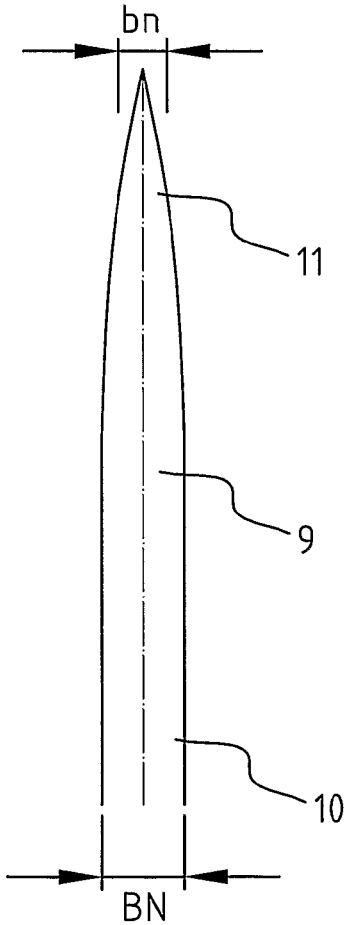
Figure 4:
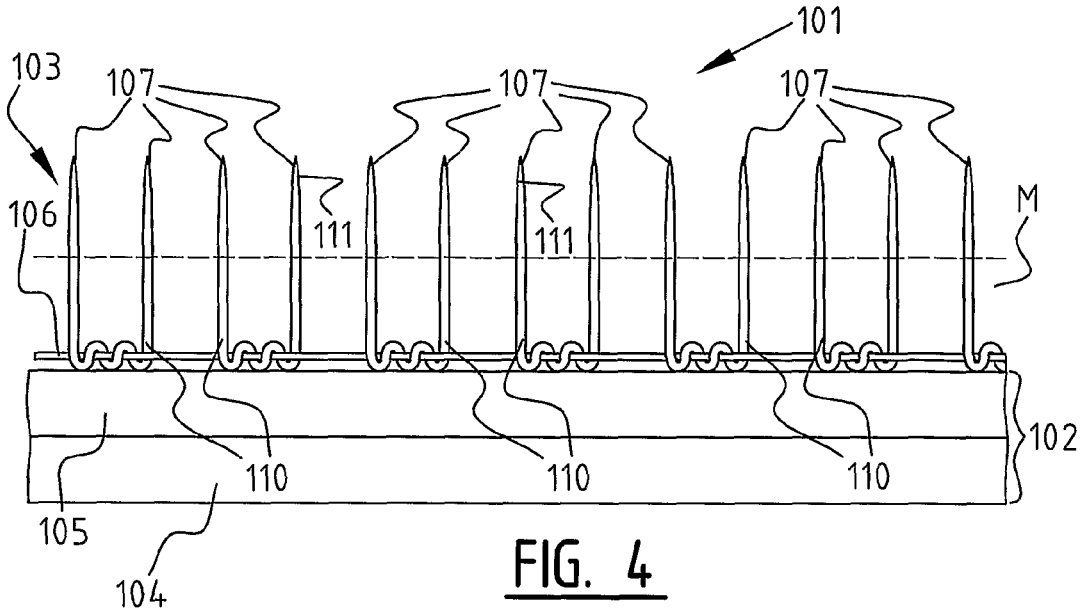
Figure 5:
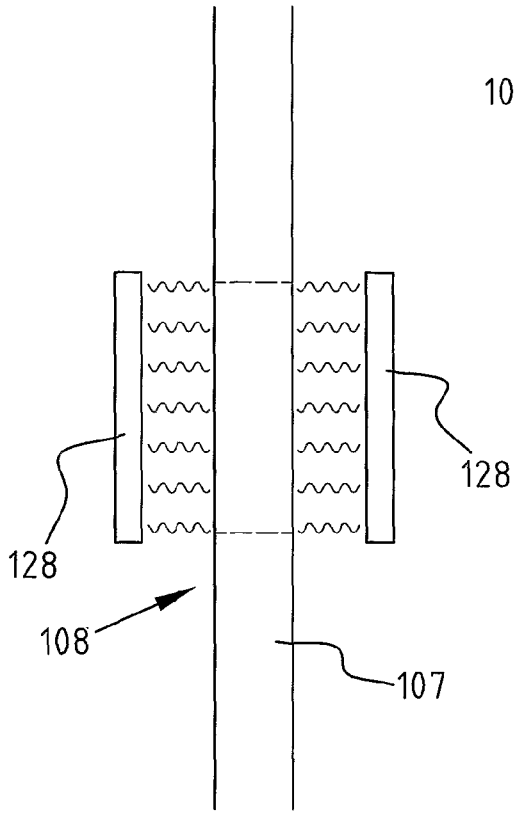
Figure 6:
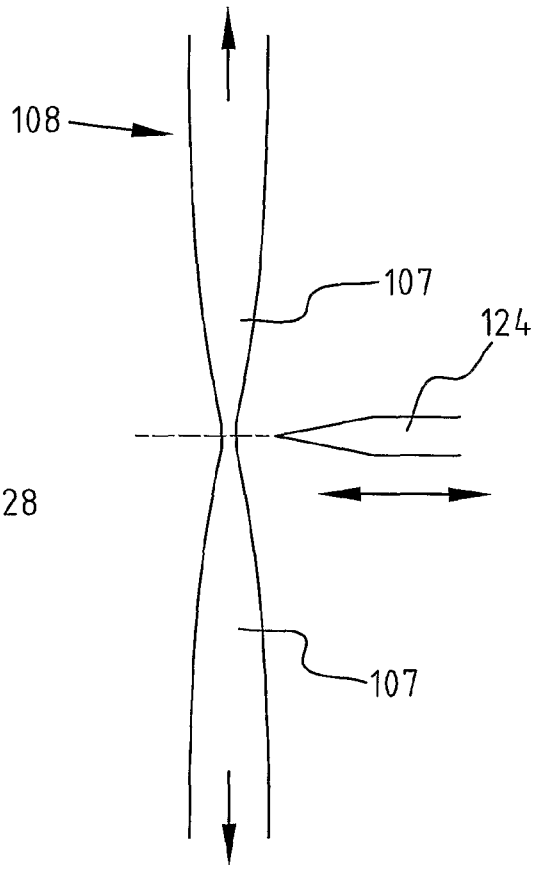
Figure 7:
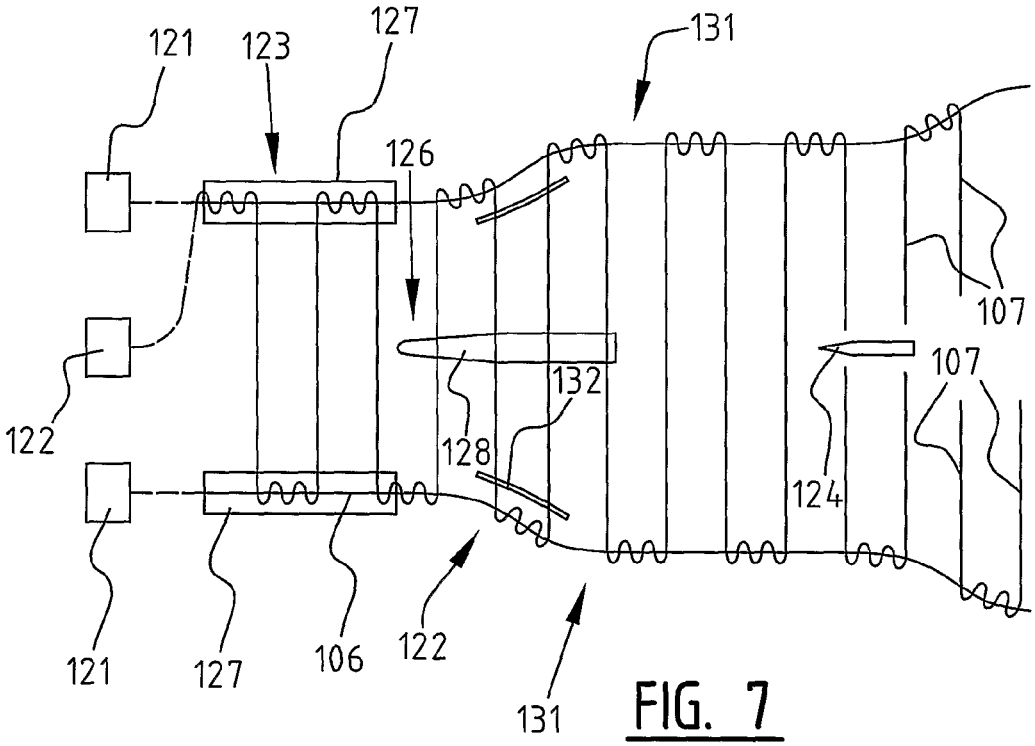
Figure 8:
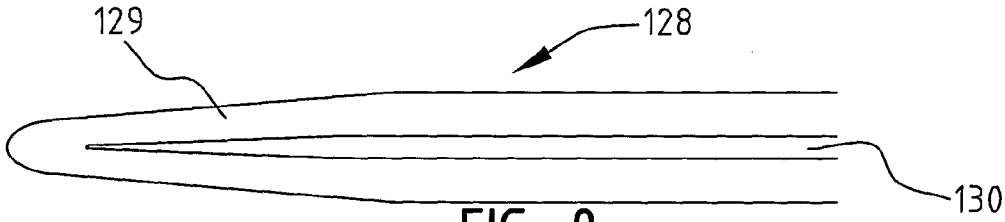
Figure 9:
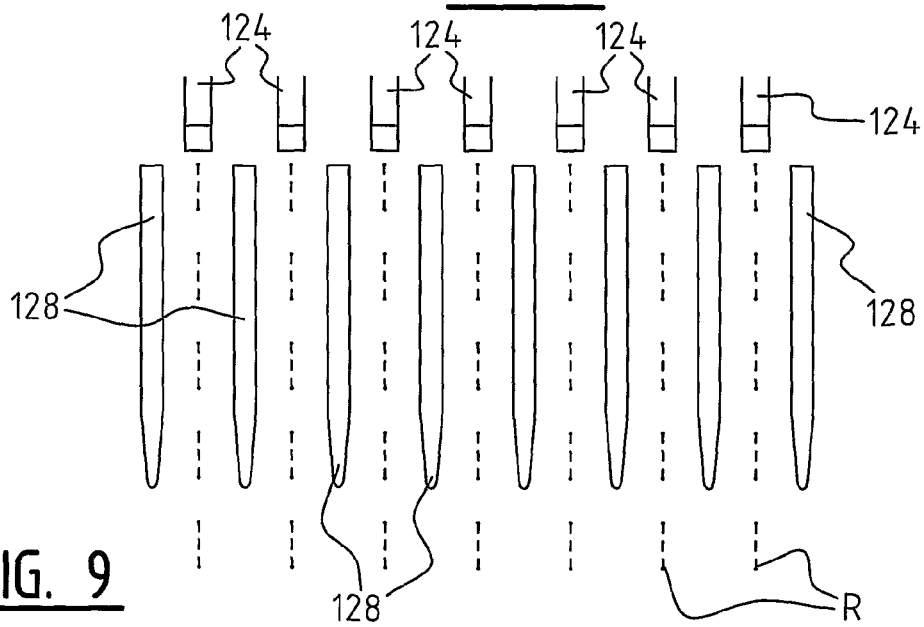

The invention is now elucidated on the basis of an embodiment, wherein reference is made to the accompanying drawing in which corresponding components are designated with reference numerals increased by 100 at a time, and in which:

FIG. 1 shows a schematic cross-section through an artificial grass field with conventional artificial grass blades, FIG. 2 shows a side view of a part of a conventional artificial grass blade formed by an extruded synthetic fibre, FIG. 3 shows a side view of a natural grass blade, FIG. 4 is a view corresponding with FIG. 1 of an artificial grass field with synthetic grass blades according to the invention, FIG. 5 shows schematically how a synthetic fibre is plasticized by local heating, FIG. 6 shows schematically how the synthetic fibre is stretched and cut after plasticizing, FIG. 7 is a schematic view of a double loom weaving method as applied for the purpose of forming artificial turf with locally narrowed artificial grass blades, FIG. 8 shows a schematic side view of a heating element used to plasticize the synthetic fibres, and FIG. 9 shows a schematic top view of a turf backing with a number of rows of artificial grass blades woven therein and the heating elements disposed therebetween.

A prior art artificial grass field 1 (FIG. 1) consists of a ground 2 and an artificial turf 3 arranged thereon. Ground 2 can in turn consist of a relatively hard base layer 4 of for instance asphalt or rubble, and a resilient damping layer 5 arranged thereon, for instance of bonded rubber granules or of a plastic foam. Artificial turf 3 consists of a backing 6 and a large number of artificial grass blades 7 which are connected to backing 6 by means of tufting, knitting or weaving. These artificial grass blades 7 stand more or less upright. The space between artificial grass blades 7 can optionally be further filled with for instance a mixture M of sand and rubber granules.

The conventional artificial grass blades 7 are manufactured from continuous synthetic fibres 8 which are connected to backing 6 in the form of loops or piles in a tufting machine, knitting machine or loom, after which these loops or piles are cut open in order to form the individual blades 7. Because blades 7 are formed from continuous synthetic fibres 8, which are in turn manufactured from a suitable plastic by means of extrusion, artificial grass blades 7 have a uniform cross-section, in the shown example with a blade width ba (FIG. 2). In this respect the artificial grass blades 7 differ greatly from natural grass blades 9 (FIG. 3), which have an irregular cross-section. This is because natural grass blades have a relatively large width BN close to their base 10, which tapers to a small width BN toward the free end or tip 11 of the grass blade. Owing to this difference in the progression of the cross-section over the length of the blade a conventional artificial grass field with uniform artificial grass blades 7 has clearly different characteristics than a natural grass field.

An artificial grass field 101 (FIG. 4) according to the present invention has essentially the same structure as the conventional artificial grass field. Here too there is a ground layer 102 consisting of a hard base layer 104 and a resilient damping layer 105. Laid on the ground layer is an artificial turf 103 consisting of a backing 106 and artificial grass blades 107 protruding roughly perpendicularly therefrom.

These artificial grass blades 107 according to the invention are distinguished from the above discussed conventional artificial grass blades 7 in that they have an irregular cross-section. They have in particular a cross-section which is narrowed locally. In the shown embodiment artificial grass blades 107 each have a base part 110 connected to backing 106 and a free end part 111, and the narrowed cross-section is located in the vicinity of free end part 111. Just as the above discussed natural grass blades 7, the artificial grass blades 107 according to the invention taper to a point.

The locally narrowed cross-section of artificial grass blades 107 can result from these blades being stretched, for instance by exerting a tensile force thereon. For practical reasons the narrowed cross-section is formed first in the manufacture of artificial turf 103 by stretching the synthetic fibres 108, and the synthetic fibres are then cut to the desired length to form artificial grass blades 107 (FIG. 6). In order to limit the force to be exerted, the artificial grass blades 107 can herein be plasticized before, during and also after the stretching, for instance by local heating thereof (FIG. 5). Plasticizing after the stretching has the particular purpose of preventing artificial grass blades 107 from becoming firmer as a result of their plastic deformation, whereby they would still acquire clearly different characteristics than natural grass blades with a corresponding cross-section.

For the purpose of forming artificial turf 103 use is made of a device 120 which is provided with first supply means 121 for supplying the backing 106, for instance in the form of a roll from which backing 106 is unwound, and second supply means 122 for supplying a large number of synthetic fibres 108, for instance in the form of a large number of bobbins from which synthetic fibres 108 are unwound. Device 120 is further provided with connecting means 123 for connecting synthetic fibres 108 to backing 106, and cutting means 124 for cutting synthetic fibres 108 to a desired length after they have been connected to backing 106.

According to the invention this device 120 is adapted to form artificial grass blades 107 with a narrowed end part 111. Device 120 is provided for this purpose with means 125 for stretching artificial grass blades 107 and means 126 co-acting with stretching means 125 for plasticizing the artificial grass blades 107.

In the shown example connecting means 123 are formed by a double loom which is provided with two spaced-apart weaving frames 127 disposed parallel to each other and discharge conveyors 131 connecting thereto. Two backings 106 can be processed simultaneously on such a double loom, so that first supply means 121 must therefore here also comprise two rolls with backings 106. Synthetic fibres 108 are here woven alternately into the lower and upper backing 106 by the two weaving frames 127.

In this embodiment of device 120 cutting means 124 are placed between discharge conveyors 131, as are plasticizing means 126. These plasticizing means 126 are adapted here to locally heat synthetic fibres 108 and/or the artificial grass blades 107 formed therefrom. In the shown embodiment the plasticizing means 126 comprise a number of heating members 128 for this purpose. As is usual in the case of artificial turf, a large number of synthetic fibres 108 are connected in mutually parallel rows R to backing 106 in the double loom. Heating members 128 are thus also disposed parallel to each other and extend in each case between these rows (FIG. 9). These heating members 128 here take the form of elongate bodies 129 having on the inside an accurately adjustable heating element 130 (FIG. 8). In order to be able to continue heating synthetic fibres 108 properly during stretching, elongate bodies 129 can take a form which is tapering or adjustable in transverse direction.

As stated, synthetic fibres 108 are first stretched and only then severed in device 120. For this purpose the stretching means 125 are adapted in the shown embodiment to move discharge conveyors 131 apart upstream of cutting means 124 as seen in the direction of movement of backings 106. Stretching means 125 can for instance comprise diverging guides 132 in the direction of movement of discharge conveyors 131.

With the above described device 120 two synthetic turfs 103 can be simultaneously provided in rapid and efficient manner with artificial grass blades 107 with narrowed end parts 111.

Although the invention has been elucidated above on the basis of an embodiment, it will be apparent that it is not limited thereto. The artificial grass blades could thus also be provided with a locally changing cross-section in a manner other than by stretching. The synthetic fibres could for instance themselves already be manufactured with variable cross-section. The blades could also be connected to the backing in a manner other than by weaving, for instance by tufting or knitting. The sectional form of the artificial grass blades could further also be varied uniformly over their full length instead of close to the free ends.

The scope of the invention is therefore defined solely by the appended claims.

The invention claimed is:

1. Artificial turf, comprising a backing and a number of artificial grass blades connected to the backing and extending substantially transversely of the surface thereof, wherein at least some of the artificial grass blades have a cross-section that varies along the length thereof, the cross-section being narrower at least at one location along the length of the artificial grass blades and the narrowed cross-section being located in a stretched portion of the artificial grass blades.

2. Artificial turf as claimed in claim 1, characterized in that the artificial grass blades comprise a base part connected to the backing and a free end part, and the narrowed cross-section is located at the position of or in the vicinity of the free end part.

3. Artificial turf as claimed in claim 2, wherein the artificial grass blades taper to a point.

4. Method for forming an artificial turf, comprising the steps of:

providing a backing, and connecting to the backing a number of artificial grass blades extending substantially transversely of the surface thereof, wherein the artificial grass blades are formed by providing a number of synthetic fibres, connecting the synthetic fibres to the backing, and cutting to a desired length the synthetic fibres connected to the backing, wherein at least some of the artificial grass blades are formed with a cross-section that varies along the length thereof, the cross-section being narrowed at least at one location along the length of the artificial grass blades; and wherein the narrowed cross-section is formed by stretching the artificial grass blades.

5. Method as claimed in claim 4, characterized in that the artificial grass blades comprise a base part connected to the backing and a free end part, and the narrowed cross-section is formed at the position of or in the vicinity of the free end part.

6. Method as claimed in claim 4, characterized in that the artificial grass blades are plasticized before, during and/or after the stretching.

7. Method as claimed in claim 6, characterized in that the artificial grass blades are plasticized by heating at least a part thereof.

8. Method as claimed in claim 4, characterized in that the synthetic fibres are connected to the backing by means of double-weaving, wherein two mutually parallel, spaced-apart backings are provided in each case and the synthetic fibres are woven through both backings and then severed between the backings, and the cross-section that varies along the length of the artificial grass blade is formed before severing of the synthetic fibres.

9. Method as claimed in claim 4, characterized in that the artificial grass blades are stretched by increasing the interspacing between the backings prior to severing of the synthetic fibres.

10. Device for forming an artificial turf, comprising:

first supply member for supplying a backing, second supply member for supplying a number of synthetic fibres, connecting member for connecting the synthetic fibres to the backing, and a cutting member for cutting to a desired length the synthetic fibres connected to the backing, wherein the device comprises a unit for forming at least some of the artificial grass blades with a cross-section that varies along the length thereof, said unit narrowing the cross-section at least at one location along the length of the artificial grass blades; and wherein the device further comprises a stretching member for stretching the artificial grass blades.

11. Device as claimed in claim 10, characterized, in that the artificial grass blades comprise a base part connected to the backing and a free end part, and the device forms the narrowed cross-section at the position of or in the vicinity of the free end part.

12. Device as claimed in claim 10, characterized by a plasticizing member co-acting with the stretching member for plasticizing the artificial grass blades.

13. Device as claimed in claim 12, characterized in that the plasticizing member heats at least a part of the artificial grass blades.

14. Device as claimed in claim 13, characterized in that the connecting member connects the synthetic fibres to the backing in mutually parallel rows, and the plasticizing member comprises a number of heating members placed between the rows.

15. Device as claimed in claim 10, characterized in that the connecting a double loom which is provided with two weaving frames disposed spaced-apart and parallel to each other, and discharge conveyors connecting thereto, the cutting member is placed between the discharge conveyors and the device gives the synthetic fibres a cross-section that varies along the length of the grass blade upstream of the cutting member.

16. Device as claimed in claim 10, characterized in that the stretching member moves the discharge conveyors apart upstream of the cutting.

* * * * *